US011958519B2

(12) United States Patent
Schulz et al.

(10) Patent No.: US 11,958,519 B2
(45) Date of Patent: Apr. 16, 2024

(54) METHOD FOR OPERATING A RAILWAY SYSTEM, AND VEHICLE OF A RAILWAY SYSTEM

(71) Applicant: SIEMENS MOBILITY GMBH, Munich (DE)

(72) Inventors: Oliver Schulz, Edemissen (DE); Matthias Seifert, Buchholz (DE)

(73) Assignee: Siemens Mobility GmbH, Munich (DE)

( * ) Notice: Subject to any disclaimer, the term of this patent is extended or adjusted under 35 U.S.C. 154(b) by 1066 days.

(21) Appl. No.: 16/464,362

(22) PCT Filed: Oct. 25, 2017

(86) PCT No.: PCT/EP2017/077280
§ 371 (c)(1),
(2) Date: May 28, 2019

(87) PCT Pub. No.: WO2018/095682
PCT Pub. Date: May 31, 2018

(65) Prior Publication Data

US 2021/0114635 A1 Apr. 22, 2021

(30) Foreign Application Priority Data

Nov. 25, 2016 (DE) ..... 102016223481.1

(51) Int. Cl.
*B61L 3/12* (2006.01)
*B61L 15/00* (2006.01)
(Continued)

(52) U.S. Cl.
CPC ..... *B61L 3/125* (2013.01); *B61L 15/0027* (2013.01); *B61L 15/0072* (2013.01); *B61L 23/00* (2013.01);
(Continued)

(58) Field of Classification Search
CPC ..... B61L 3/125; B61L 27/04; B61L 27/40; B61L 27/50; B61L 27/53; B61L 27/70;
(Continued)

(56) References Cited

U.S. PATENT DOCUMENTS

2004/0124315 A1 7/2004 Kane et al.
2009/0212168 A1* 8/2009 Kumar ..... B61L 27/53 246/167 R (Continued)

FOREIGN PATENT DOCUMENTS

CN 101567780 A 10/2009
CN 105025479 A 11/2015

(Continued)

*Primary Examiner* — Russell Frejd
*Assistant Examiner* — Sara J Lewandroski
(74) *Attorney, Agent, or Firm* — Laurence A. Greenberg; Werner H. Stemer; Ralph E. Locher

(57) ABSTRACT

A method for operating a railway system. Cryptographic data which includes at least one key and/or at least one digital certificate is stored in a storage device of a vehicle of the railway system. The vehicle transmits the cryptographic data to at least one track-side device of the railway system when the vehicle is in communication range of the least one track-side device as part of the train travel. There is also described a corresponding rail vehicle of a railway system.

17 Claims, 3 Drawing Sheets

(51) Int. Cl.

| | |
|---|---|
| ***B61L 23/00*** | (2006.01) |
| ***B61L 27/00*** | (2022.01) |
| ***B61L 27/40*** | (2022.01) |
| ***B61L 27/53*** | (2022.01) |
| ***B61L 27/70*** | (2022.01) |

(52) U.S. Cl.
CPC ..... *B61L 27/40* (2022.01); *B61L 27/53* (2022.01); *B61L 27/70* (2022.01); *B61L 2205/00* (2013.01)

(58) Field of Classification Search
CPC ..... B61L 15/0018; B61L 15/0027; B61L 15/0072; B61L 15/0081
See application file for complete search history.

(56) References Cited

U.S. PATENT DOCUMENTS

| | | | | |
|---|---|---|---|---|
| 2014/0109214 | A1* | 4/2014 | Siu | H04L 63/02 726/15 |
| 2016/0107663 | A1 | 4/2016 | Cooper et al. | |

FOREIGN PATENT DOCUMENTS

| | | | | |
|---|---|---|---|---|
| CN | 205725863 | U | 11/2016 | |
| DE | 102007041177 | A1 | 3/2009 | |
| DE | 102014226902 | A1 | 1/2016 | |
| EP | 0997807 | A2 | 5/2000 | |
| EP | 1220094 | A1 | 7/2002 | |
| EP | 1870308 | A2 | 12/2007 | |
| JP | 2014050038 | A | 3/2014 | |
| WO | WO-2009027380 | A1 * | 3/2009 | B61L 15/0027 |
| WO | 2012136525 | A1 | 10/2012 | |
| WO | WO-2013041332 | A1 * | 3/2013 | B61L 1/10 |

* cited by examiner

METHOD FOR OPERATING A RAILWAY SYSTEM, AND VEHICLE OF A RAILWAY SYSTEM

BACKGROUND OF THE INVENTION

Field of the Invention:

Modern system components of railway signaling are now often interconnected via networks, e.g. using the Ethernet standard. As a consequence, corresponding networks are exposed to safety risks, e.g. in the form of hacker attacks. In extreme cases, corresponding attacks can represent a threat to the safe operation of railway systems and therefore to the people using these systems. In order to detect or prevent, for example, any invalid influence on e.g. a track switch or a railway signal, or any modification of sensor data, encryption and authentication methods are routinely deployed in known system architectures. In this case, the keys and certificates required for corresponding methods in the context of e.g. a public-key infrastructure must normally be changed at regular time intervals in order to prevent a potential attacker from discovering the secret key or secret certificate by means of long-term observation or extensive arithmetic operations.

In practice, the situation may arise in a project that signaling installations have to be constructed far away from a central location, and that a link from said signaling installations to a central communication infrastructure of the relevant railway system is not possible for reasons of cost or for other reasons. This can occur in the case of mine railways, for example, in large and remote areas or in other locations which are not linked by technical communications means. In such situations, one possibility is to set up so-called "interlocking islands" which may consist of a plurality of control components, possibly in the form so-called element controllers, for example, and/or a local interlocking facility. So-called "sidings", i.e. passing points or passing tracks at which oncoming trains can safely encounter each other in the case of single-track line sections, are cited as an example of such locations. In addition, such decentral and often isolated locations usually have no supervisor, i.e. the devices or installations control the safety in a fully automatic manner. For this purpose, e.g. an Ethernet network connection can be set up between the respective control components and the respective local interlocking, in order that the relevant signal components can communicate with each other and ensure the safety of the railway operation. In situations such as these, the keys and certificates used in the context of communication should or must likewise be changed from time to time. In the absence of a connection by technical communication means to a control center or a central device of the railway system, this is however difficult to organize or is only possible if a corresponding maintenance measure is performed locally by maintenance staff, for example. However, this has the disadvantage of significant associated costs and overheads.

SUMMARY OF THE INVENTION

The object of the present invention is to specify a method for operating a railway system, which allows cryptographic data to the transmitted to track-side devices of the railway system in an inexpensive manner, even if a communication link is not present.

This object is inventively achieved by a method for operating a railway system, wherein cryptographic data comprising at least one key and/or at least one digital certificate is stored in a storage device of a vehicle of the railway system and the cryptographic data is transmitted from the vehicle to the at least one track-side device of the railway system when said vehicle is present in communication range of at least one track-side device during a journey.

According to the first step of the inventive method for operating a railway system, cryptographic data comprising at least one key and/or at least one digital certificate is stored in a storage device of a vehicle of the railway system. This means that the corresponding cryptographic data is saved in the storage device of the vehicle. In this case, the storage device of the vehicle is preferably a type of storage device which is a permanent component of the vehicle, i.e. assigned to e.g. a control device, possibly in the form of an on-board computer, of the vehicle. Alternatively, the storage device can also be linked to a corresponding control device of the vehicle solely by technical communication means. In the latter case, the storage device can be e.g. a mobile storage medium, possibly in the form of a USB stick or a mobile communication terminal, which is linked to the control system of the vehicle during the operational mode of the vehicle.

According to the second step of the inventive method, cryptographic data is transmitted from the vehicle to at least one track-side device of the railway system when said vehicle is present in communication range of at least one track-side device during a journey. In respect of the cryptographic data, the vehicle is therefore used as a transport means to the extent that it transports the cryptographic data, or the storage device in which the cryptographic data is saved, to a location which is situated in the communication range of the at least one relevant track-side device. The term "communication range" is therefore understood to mean that communication between the vehicle and the at least one track-side device is possible at the relevant distance or in the relevant region. This means in particular that a transmission or transfer of the cryptographic data to the at least one track-side device is possible in the communication range by means of the relevant communication means. To the extent that it is required for a corresponding transmission in the respective individual case, this can also mean that a transmission of data or messages from the at least one track-side device to the vehicle is also possible in the communication range. Irrespective of the actual design of the data transmission, the cryptographic data is transmitted to the at least one track-side device of the railway system when the vehicle during its journey has reached the communication range of the at least one track-side device or is present within the communication range. In this case, the transmission of the cryptographic data from the vehicle to the at least one track-side device preferably takes place during a regular journey of the vehicle, thereby avoiding an additional journey solely for the purpose of transporting the storage device and transmitting the cryptographic data.

The inventive method is advantageous because it allows track-side devices of a railway system, even those arranged at remote locations, to be linked to a central device of said railway system in a manner which requires few resources and is therefore economical, to the effect that cryptographic data is transmitted from the central device or control center to the respective track-side device by means of a vehicle of the railway system. In order to achieve this, the storage device with the cryptographic data is transported by the vehicle to a location which is situated in the transfer range of the at least one track-side device. The cryptographic data is then transmitted from the vehicle to the at least one track-side device at this location or in a corresponding region. It is thereby possible to realize a "vehicle-based" or "train-based" public-key infrastructure, in which the communication between a central device which can also be referred to as a central communication infrastructure, and decentral signaling installations without a link to the central communication infrastructure, is realized by means of vehicles of the railway system. The inventive method advantageously executes automatically here, to the effect that no manual actions or interventions are required for the purpose of transmitting the cryptographic data. In the context of the inventive method, the vehicle can be a vehicle of any desired type. This includes in particular vehicles in the form of locomotives, traction units and trains, wherein said trains can be passenger trains or goods trains.

According to a particularly preferred development of the inventive method, the cryptographic data is transmitted wirelessly, in particular via radio, from the vehicle to the at least one track-side device. In this case, the terms "wireless" and "via radio" are understood to mean that at least part of a communication connection between the vehicle and the at least one track-side device is realized accordingly. This will normally relate in particular to a section or partial section, starting from the vehicle, of a communication connection with the at least one track-side device. In addition to a transfer via radio, the wireless transmission of the cryptographic data from the vehicle to the at least one track-side device can in principle also be a transfer using optical means, for example. Furthermore, the rails could also be used as a transport medium, in which case at least the partial section between the vehicle and the rails would be wirelessly embodied. Radio-based transmission of the cryptographic data is however normally preferred due to the particular resilience thereof and the fact that radio-based transmission is often already available anyway. It is sufficient in this case for the chosen radio system to allow a transfer or transmission over short to medium distances, i.e. several hundred meters, for example. Of importance here is solely that the transfer range is adequately dimensioned to ensure a reliable transmission of the cryptographic data from the vehicle to the at least one track-side device of the railway system.

The inventive method can also advantageously be designed in such a way that the cryptographic data is transmitted from a central device of a public-key infrastructure of the railway system to the vehicle and stored in the storage device by the vehicle. A corresponding central device can be, for example, a component in the form of a Certification Authority or a Registration Authority. In this case, the term "central" device as distinct from the at least one track-side device is understood to mean that the central device of the public-key infrastructure of the railway system is linked to a central communication infrastructure of the railway system while this is specifically not the case for the at least one track-side device. The transmission of the cryptographic data from the device to the vehicle is likewise advantageously effected wirelessly, i.e. in particular via radio. An automated computer-controlled sequence, including the storage of the cryptographic data in the storage device, is therefore supported and/or ensured by this means.

The inventive method can preferably also be developed in such a way that supplementary information comprising at least one of the following characteristic variables is provided to the vehicle: identity of the at least one track-side device, communication address of the at least one track-side device, location of the at least one track-side device, extent of the communication range, location of a respective line at or after which the cryptographic data must be transmitted from the vehicle to the at least one track-side device. This embodiment variant of the inventive method has the advantage that the cited supplementary information is suitable for ensuring a reliable and smooth transmission of the cryptographic data from the vehicle to the at least one track-side device. The relevant characteristic variables therefore relate in particular to information of a type which allows or assists the vehicle to establish a communication connection with the at least one track-side device, or which informs the vehicle where the at least one track-side device is arranged. Effective communication between the vehicle and the at least one track-side device is therefore enabled by this means.

In the context of the inventive method, it is essentially possible that the at least one track-side device to which the cryptographic data is transmitted is actually the component for which the cryptographic data is destined. In this case, no onward distribution or forwarding of the cryptographic data is therefore required on the track side.

According to a further particularly preferred embodiment variant of the inventive method, a local management device of the railway system is used as a track-side device and the cryptographic data is distributed from the local management device to at least one further local component of the railway system. In particular, this has the advantage that if the cryptographic data is destined for a plurality of components, the cryptographic data need only be transmitted from the vehicle to the track-side device in the form of the local management device of the railway system, whereby communication of the vehicle with the plurality of track-side components is therefore avoided. The local management device of the railway system can be, for example, a local Registration Authority or a local Certification Authority which is part of a public-key infrastructure and manages one or more further local components of the railway system, e.g. for the distribution of digital certificates. The further local components in this case may be embodied as e.g. fail-safe signaling devices, i.e. as element controllers, for example.

In the context of the inventive method, it is essentially possible for the cryptographic data to be transmitted from the vehicle to the at least one track-side device during the stoppage of the vehicle. Such a course of action may be appropriate, for example, if a halt of the vehicle is required or takes place anyway in the vicinity of the at least one track-side device. For example, this may be the case if the track-side device is located in the region of a passing track and the vehicle must halt at the relevant position anyway in order to allow an oncoming vehicle to pass.

According to a particularly preferred development of the inventive method, the cryptographic data is transmitted from the vehicle to the at least one track-side device during the journey. In this case, the cryptographic data is therefore transmitted to the at least one track-side device as the vehicle passes by said track-side device. This has the advantage that delays in the journey of the vehicle due to the required transmission of the cryptographic data are avoided. Therefore the corresponding transmission here preferably takes place while the vehicle and the at least one track-side device are situated within communication range of each other as the vehicle passes by, without the vehicle being decelerated or stopped for this purpose.

The inventive method can also advantageously be designed in such a way that the cryptographic data is encrypted or otherwise protected when it is transmitted from the vehicle to the at least one track-side device. It is therefore ensured by this means that the transmission of the cryptographic data itself also satisfies normal safety requirements and in particular any corruption of the cryptographic data is reliably prevented. In addition to a transmission of the cryptographic data which is encrypted and optionally protected by digital signature, said cryptographic data can also be protected by other means such as embedding the cryptographic data in intrinsically safe containers, for example.

The inventive method can also advantageously be designed in such a way that data is transmitted from the track-side device or at least one of the track-side devices to the vehicle or to another vehicle which is present within the communication range at the given time point, the transmitted data is stored in the storage device of the relevant vehicle and is forwarded from the relevant vehicle beyond the communication range of the at least one track-side device to a central device of the railway system. The inventive method can therefore also be developed to the effect that data is transmitted by means of the vehicle from the track-side device or at least one of the track-side devices to a central device of the railway system. In order to achieve this, the relevant data is transmitted from the respective track-side device to the vehicle or to another vehicle which is present within the communication range at the given time point, and is forwarded from said vehicle, beyond of the communication range of the at least one track-side device, to the central device of the railway system. In this context, the transmission of the data from the respective track-side device to the vehicle can take place in temporal conjunction with the transmission of the cryptographic data from the vehicle to the at least one track-side device. This means that the data can be transmitted at the same time as the cryptographic data is transmitted in the opposite direction, or sequentially immediately after or before transmission of the cryptographic data takes place. However, it is also possible for the data from the track-side device to be transmitted to the vehicle, or to the other vehicle which is present in the receiving range at the given time point, in a manner which is temporally independent of the transmission of the cryptographic data. Irrespective of the time point at which the data is transmitted, this may be data or information of any desired type. This includes both further cryptographic data or data associated with cryptographic procedures, and diagnostic data that has been recorded or indicators and reports concerning safety-related events.

According to a further particularly preferred embodiment variant of the inventive method, procedures comprising a plurality of communication steps, e.g. in the form of an update of certificates or transmission of a certificate black list, are realized by means of at least one further journey of the vehicle or at least one further vehicle. This means that more complex procedures or communication sequences, such as "handshake" procedures based on the "Certificate Management Protocol" (CMP), for example, can also be realized using vehicles for the purpose of transmitting the relevant data or messages. This can be done either by means of journeys of the same vehicle or journeys of different vehicles in this case.

The invention further relates to a vehicle of a railway system.

In respect of the vehicle, the object of the present invention is to specify a vehicle of a railway system, wherein said vehicle allows a transmission of cryptographic data to track-side devices of the railway system in a manner which requires few resources, even in the absence of a communication link.

This object is inventively achieved by a vehicle of a railway system, said vehicle having a storage device in which is stored cryptographic data that comprises at least one key and/or at least one digital certificate, a control device for detecting that the vehicle is present in communication range of at least one track-side device of the railway system during a journey, and a communication device for transmitting the cryptographic data to the at least one track-side device.

The advantages of the inventive vehicle correspond essentially to those of the inventive method, and therefore reference is made to the corresponding explanations above in this regard. The same applies to the preferred development as cited below of the inventive vehicle in relation to the corresponding preferred development of the inventive method, and therefore reference is again made to the corresponding explanations above in this regard.

The inventive vehicle can advantageously be designed in such a way that the communication device is embodied for wireless transmission, in particular via radio, of the cryptographic data from the vehicle to the at least one track-side device.

The invention further comprises a railway system having at least one inventive vehicle or at least one vehicle according to the preferred development of the inventive vehicle, and having a central device which is so embodied as to transmit the cryptographic data to the vehicle, said vehicle being so embodied as to store the cryptographic data in the storage device.

In respect of the advantages of the inventive railway system and its preferred developments as cited below, reference is again made to the corresponding explanations in connection with the respective preferred development of the inventive method.

In addition, the inventive railway system can preferably be developed in such a way that the railway system is so embodied as to provide the vehicle with supplementary information comprising at least one of the following characteristic variables: identity of the at least one track-side device, communication address of the at least one track-side device, location of the at least one track-side device, extent of the communication range, location of a respective line at or after which the cryptographic data must be transmitted from the vehicle to the at least one track-side device.

According to a particularly preferred embodiment variant of the inventive railway system, the track-side device is a local management device of the railway system and the local management device is so embodied as to distribute the cryptographic data to at least one further local component of the railway system.

According to a further particularly preferred development of the inventive railway system, said system is so embodied as to perform the method according to the claims.

BRIEF DESCRIPTION OF THE SEVERAL VIEWS OF THE DRAWING

The invention is explained in greater detail below with reference to exemplary embodiments. To this end.

DESCRIPTION OF THE INVENTION

In the figures, the same reference signs are used for identical or functionally identical components.

Figure 1:
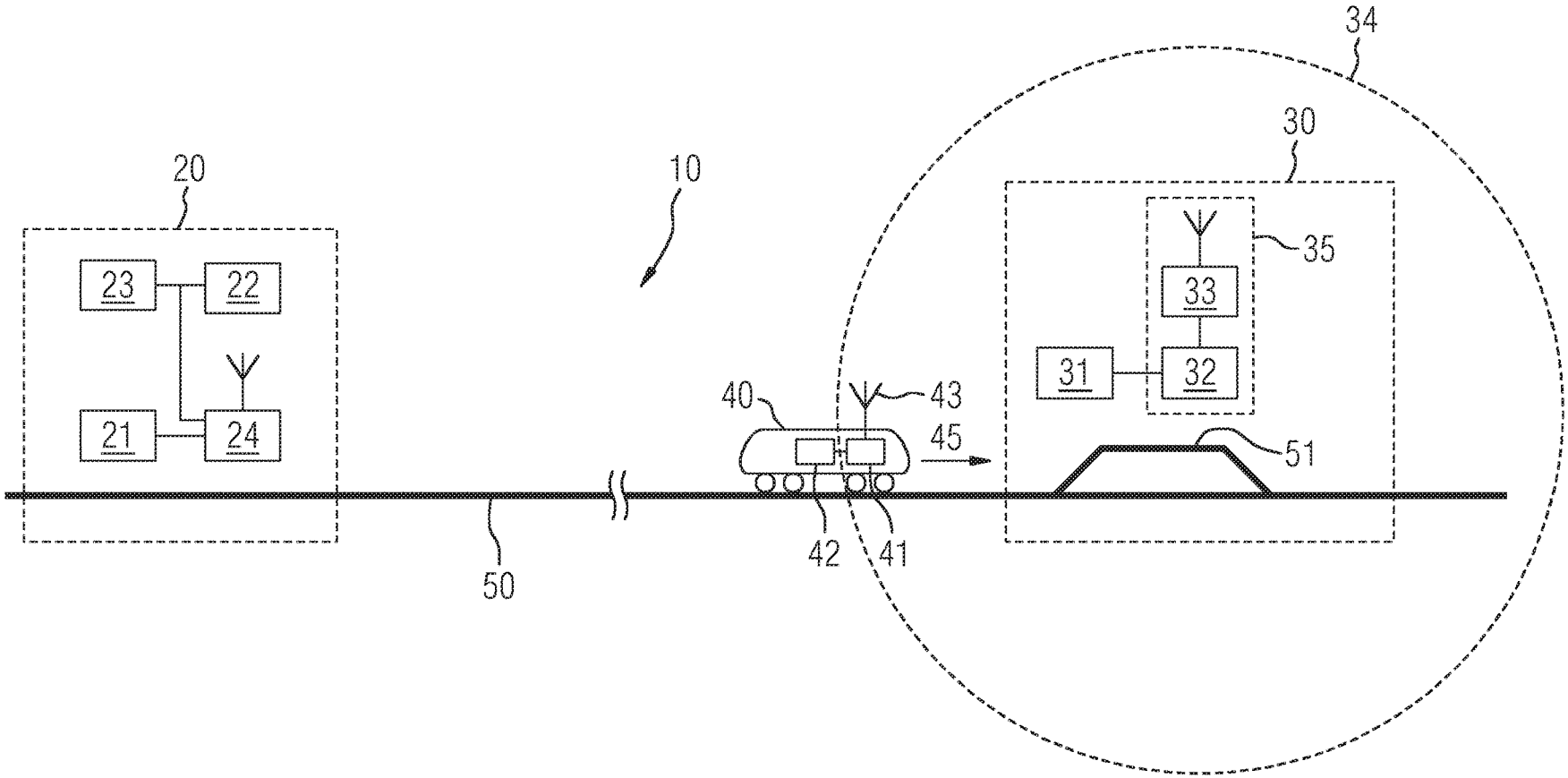
FIG. 1 shows in a first schematic illustration, for the purpose of explaining an exemplary embodiment of the inventive method, an exemplary embodiment of the inventive railway system including an exemplary embodiment of the inventive vehicle.

FIG. 1 shows in a first schematic illustration, for the purpose of explaining an exemplary embodiment of the inventive method, an exemplary embodiment of the inventive railway system including an exemplary embodiment of the inventive vehicle. Illustrated is a railway system 10 comprising on one side a central device 20, which can also be referred to as a central communication infrastructure or control center. In the illustrated exemplary embodiment, the central device 20 comprises a central management and/or control device 21 which is used to manage and/or control the railway system 10. Also provided for the purpose of realizing a public-key infrastructure are a Registration Authority 22 (RA) and a Certification Authority 23 (CA). Together with further components if applicable, the Registration Authority 22 and the Certification Authority 23 form the public-key infrastructure, i.e. a system which can issue, distribute and check digital certificates. The certificates issued within the public-key infrastructure are used in this case within the railway system 10 for the purpose of protecting computer-based communication.

The central device 20 of the railway system 10 further comprises a central communication device 24, which provides or allows communication via radio in the illustrated exemplary embodiment. The components 21, 22, 23 and 24 of the central device 20 of the railway system 10 are indirectly or directly connected to each other by wireless or wire-based technical communication means. In this case, by way of example, FIG. 1 shows an architecture in which the Registration Authority 22 and the Certification Authority 23 are directly connected to each other and indirectly connected via the central communication device 24 to the central management and/or control device 21.

In addition to the central device 20, the railway system 10 also comprises a decentral device 30 which, in the context of the described exemplary embodiment, comprises components that control and/or monitor the fail-safety of a passing point or a passing track 51 in relation to a route 50, i.e. a track or rails, such that any meeting of vehicles on the route 50 is prevented or vehicles meeting on the route 50 in the form of the single-track section can pass each other at the passing point 51.

Specifically, the decentral device 30 in the illustrated exemplary embodiment comprises a fail-safe signaling device 31, which can be e.g. a signal and/or an element controller that controls a track switch, and a local management device 32 which may be embodied as e.g. a local Registration Authority or a local Certification Authority, i.e. likewise forms a component of the public-key infrastructure. According to the illustration in FIG. 1, the local management device 32 is linked to a decentral communication device 33 in the form of a radio transfer device and together with this forms a track-side device 35.

It should be noted that the decentral device 30, which can also be referred to as an interlocking island, may comprise further components which are not shown in FIG. 1 for reasons of clarity. This relates to e.g. a decentral interlocking facility and if applicable further fail-safe signaling devices, which are preferably likewise connected to each other by technical communication means.

In order to ensure the safety of the data transfer and therefore ultimately the safety of the operation of the railway system 10, information or messages or data sent between the decentral devices 30 of the railway system 10 are digitally signed and encrypted. By virtue of the public-key infrastructure, an asymmetric encryption system is realized here in which the sending unit requires the public key of the respective receiver in each case in order to perform an encrypted transmission. In order to prevent corruption, it must be ensured here that the relevant key is actually the respective public key of the respective receiver, and not a forgery by an attacker or fraudster. In order to achieve this, use is made of digital certificates which confirm the authenticity of a public key and optionally the permitted scope of application and validity thereof. The digital certificate itself is protected here by a digital signature, whose authenticity can be checked using the public key of the issuer of the certificate. In order to ensure the continuous safety of the railway system 10, it is necessary or appropriate for keys and certificates that are used to be changed at regular intervals. This therefore applies likewise in relation to the corresponding keys and/or certificates of the decentral device 30 of the railway system 10.

In the context of the exemplary embodiment described here, it is now assumed that the decentral device 30 is situated at a location which is far away from the central device 20 of the railway system 10 and to which no communication connection exists. This can apply to mine railways, for example, which operate in large remote areas whose access by technical communication means for the purpose of linking the decentral device 30 to the central device 20 would incur disproportionately high costs or is impractical or impossible for other reasons. Even if the decentral device 30 is able autonomously to ensure the fail-safety in the region of the passing point 51, the problem exists in relation to the current encryption system that, in the absence of a link by technical communication means to the central device 20, an update or replacement of cryptographic data in the decentral device 30, in particular in the form of keys and/or certificates, is not readily possible. Corresponding cryptographic data could still be updated or replaced by maintenance staff in the context of maintenance measures. However, this would necessitate a trip by the maintenance staff to the relevant location and would therefore be comparatively expensive and resource-intensive.

In order to allow a transmission of cryptographic data from the central device 20 of the railway system 10 to the decentral device 30 of the railway system 10 in this situation, it is now advantageously possible to use a vehicle 40 of the railway system 10 as part of an automated sequence. Said vehicle 40 has an on-board control device 41, an on-board storage device 42 and an on-board communication device 43. The communication device 43 is likewise embodied for communication via radio in this case, specifically such that a data transfer via radio is possible between the decentral communication device 33 and the on-board communication device 43. The range of communication or transfer that is provided here by the communication devices and communication protocols and by the type of data transmission (unidirectional or bidirectional) in use is indicated in FIG. 1 in the form of a receiving region 34 of the decentral communication device 32. It is assumed here that the decentral communication device 32 only has a short or medium (transmission) range and therefore it is only possible to establish a communication connection between the on-board communication device 43 and the decentral communication device 33 within the circular receiving region 34, whose radius may be one hundred meters or several hundred meters, for example.

Cryptographic data is stored in the storage device 42 of the vehicle 40 and comprises at least one key and/or at least one digital certificate. When the vehicle 40 moving in the direction of travel 45 approaches the decentral device 30 to the extent that it is situated in communication range of the decentral communication device 33, and therefore communication between the decentral communication device 33 and the on-board communication device 43 is possible, the cryptographic data can be read out from the storage device 42 and transmitted via the decentral communication device 33 to the track-side device 35 or to the local management device 32 thereof. For this purpose, the control device 41 of the vehicle 40 is so embodied as to detect that the vehicle 40 has moved close enough to the track-side device during its journey. In order to achieve this, the control device 41 can use supplementary information which is preferably likewise saved in the storage device 42 and which preferably comprises as a characteristic variable at least the identity of the at least one track-side device, a communication address of the at least one track-side device, the location of the at least one track-side device, the extent or distance of the communication range and/or the location of the line 50 at or after which the cryptographic data must be transmitted from the vehicle 40 to the track-side device 35. The vehicle 40 or its storage device 42 can therefore advantageously be used to transport the cryptographic data, whereby a decentral communication device 33 having a comparatively shorter communication range can be used by the decentral device 30 in particular.

In advance of the journey of the vehicle 40 to the track-side device 35, the cryptographic data can be transmitted e.g. from the Registration Authority 22, the Certification Authority 23 or the central management and/or control device 21 of the central device 20, e.g. likewise via radio, to the vehicle 40 where following receipt by the on-board communication device 43 it is stored in the storage device 42 by means of the control device 41. This step therefore takes place at a time point prior to the situation illustrated in FIG. 1, i.e. an earlier time point when the vehicle 40 is located closer to the central device 20 and therefore a corresponding transfer via radio is possible.

In the situation illustrated in FIG. 1, the vehicle 40 has moved just close enough to the track-side device for the cryptographic data to be transmitted from the vehicle 40 the track-side device 35. It is then possible for the cryptographic data to be distributed from the local management device 32 to at least one further local component of the railway system 10 in the form of the fail-safe signaling device 31 and further fail-safe signaling devices if applicable. The transfer or transmission of the cryptographic data from the vehicle 40 to the track-side device 35 or the local management device 32 thereof advantageously takes place here during the journey of the vehicle 40, such that retardation or interruption of the journey of the vehicle 40 is not necessary. This means that the cryptographic data can be transmitted without adversely affecting the regular operation of the vehicle 40. In this case, the transmission of the cryptographic data from the vehicle 40 to the at least one track-side device is advantageously encrypted or otherwise protected, such that attacks or corruption of the cryptographic data are prevented.

Figure 2:
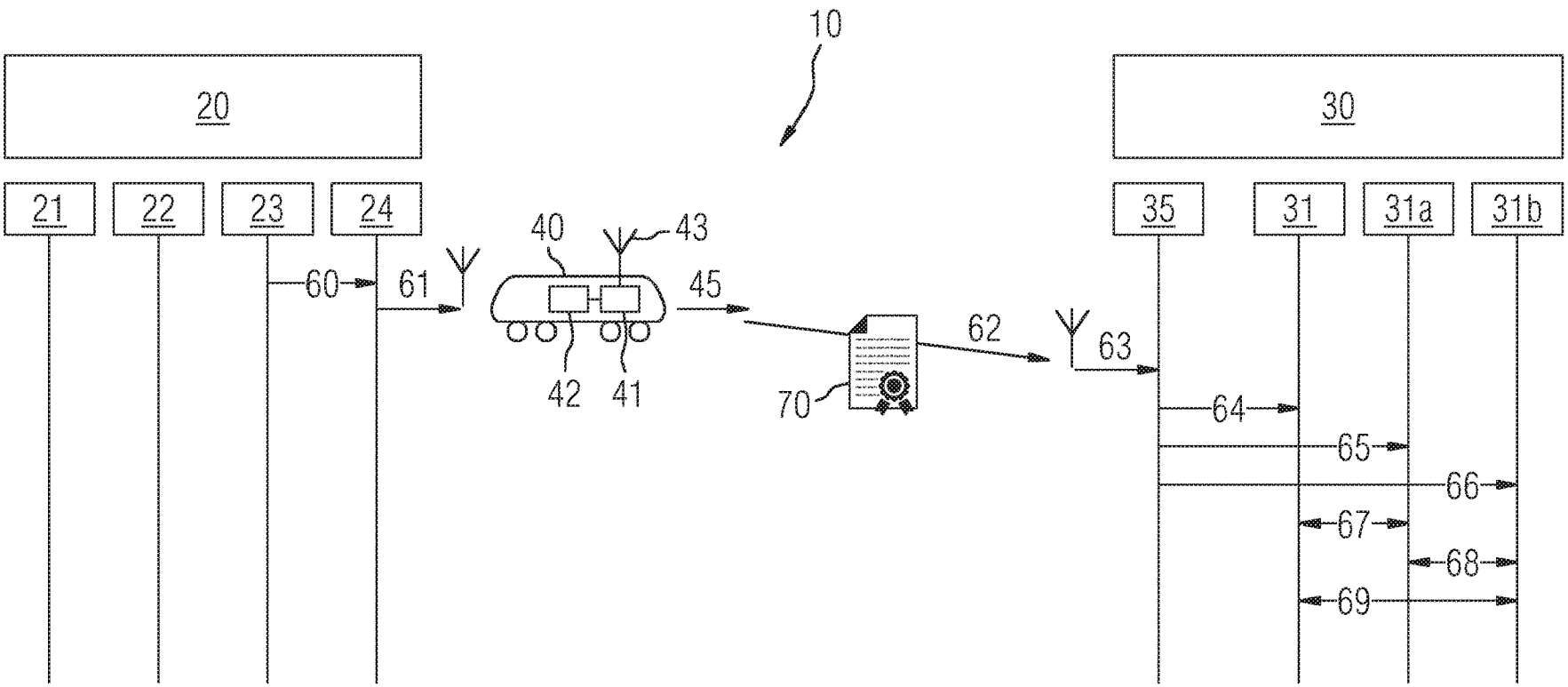
FIG. 2 shows a second schematic illustration for the purpose of further explaining the exemplary embodiment of the inventive method.

FIG. 2 shows a second schematic illustration in order to further explain the exemplary embodiment of the inventive method. The illustration in FIG. 2 corresponds to a sequence diagram, the central device 20 of the railway system being shown on the left-hand side and comprising as per the exemplary embodiment in FIG. 1 the central management and/or control device 21, the Registration Authority 22, the Certification Authority 23 and the central communication device 24. Correspondingly, the decentral device 30 is illustrated on the right-hand side of FIG. 2 and comprises the track-side device 35 and the fail-safe signaling device 31 as per the exemplary embodiment in FIG. 1. Further fail-safe signaling devices 31*a* and 31*b* are also indicated in FIG. 2.

A transmission of cryptographic data from the central device 20 to the decentral device 30 can now take place in such a way that, for example, the relevant cryptographic data is transmitted e.g. from the Certification Authority 23 in a message 60 to the central communication device 24. From the central communication device 24, the cryptographic data is transmitted in a message 61 via radio to the on-board communication device 43 of the vehicle 40 and is stored in the storage device 42 via intermediate switching of the control device 41. The vehicle 40 subsequently travels in the direction of travel 45 towards the decentral device 30 and at some point reaches the communication range of the track-side device 35. This is detected by the control device 41, whereupon the cryptographic data is transmitted via radio in a message 62 to the track-side device 35, which receives this as a message 63. For this transmission step, which is therefore temporally independent of the transfer of the cryptographic data to the vehicle 40, the cryptographic data is depicted and identified by the reference sign 70 in FIG. 2. Notwithstanding this, the relevant cryptographic data is also completely or partially contained in the messages 60, 61 and 63 and in the subsequent messages 64, 65 and 66, wherein for the sake of clarity a corresponding graphical depiction of the cryptographic data is omitted for these messages.

From the track-side device 35, the cryptographic data or the parts thereof which are relevant to the respective components are transmitted by means of the messages 64, 65 and 66 to the fail-safe signaling devices 31, 31*a* and 31*b*. As a result of this, it is subsequently possible for said devices to continue to communicate securely with each other on the basis of updated or replaced keys and/or certificates, this being indicated in FIG. 2 by means of messages 67, 68 and 69.

Figure 3:
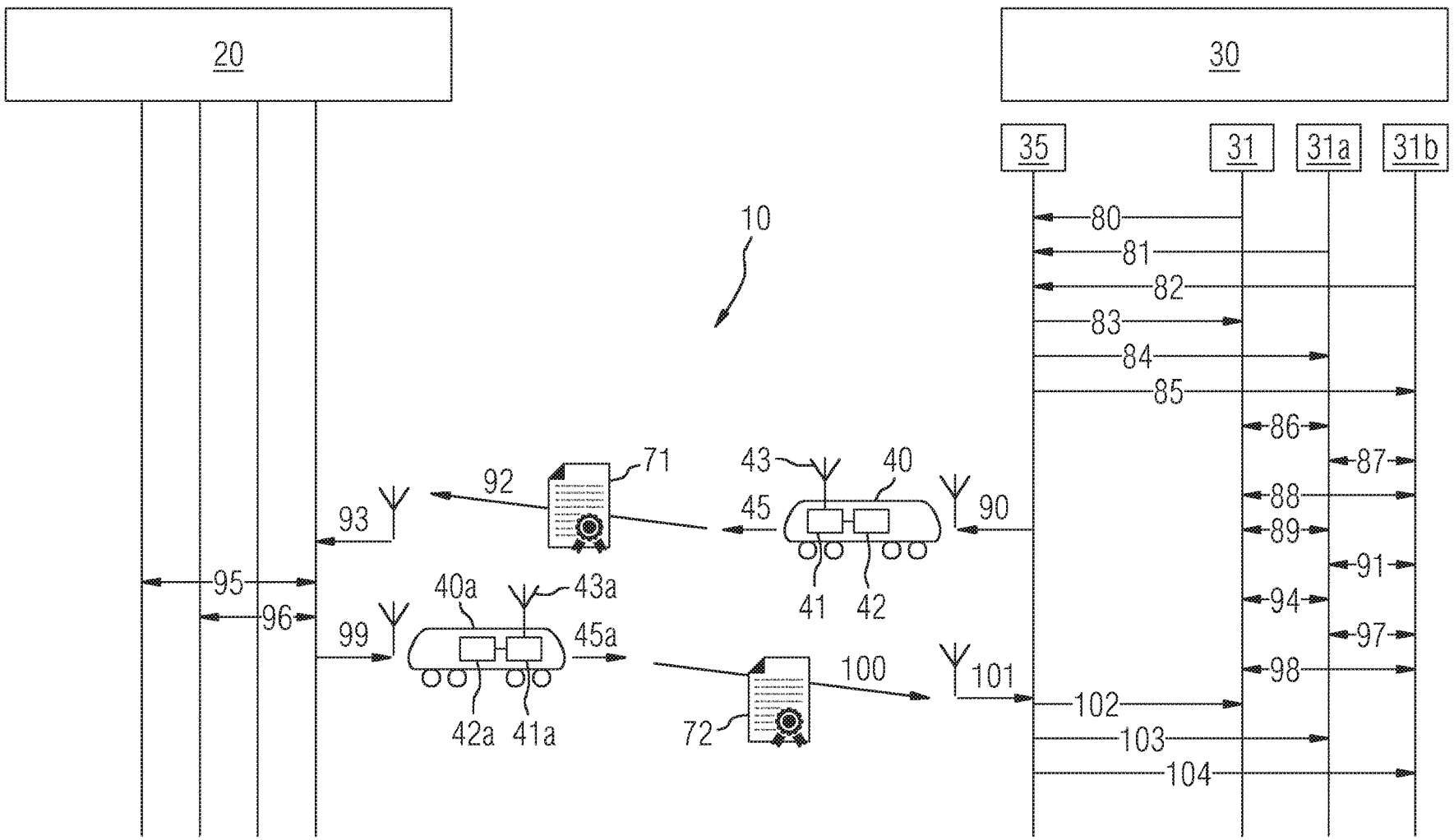
FIG. 3 shows a third schematic illustration for the purpose of explaining a further exemplary embodiment of the inventive method.

FIG. 3 shows a third schematic illustration in order to explain a further exemplary embodiment of the method according to the invention. The illustration in FIG. 3 corresponds essentially to that in FIG. 2, a separate illustration of the individual components being omitted in respect of the central device 20. This is intended to indicate that these components can themselves be variously embodied.

In the exemplary embodiment according to FIG. 3, an exchange of communication first takes place between the fail-safe signaling device 31 and the further fail-safe signaling devices 31*a*, 31*b* and the track-side device 35 (or the local management device 32 thereof) by means of messages 80, 81 and 82. These may be, for example, queries in the context of public-key infrastructure procedures, which are answered by the track-side device 35 in the form of messages 83, 84 and 85. The fail-safe signaling devices 31, 31*a* and 31*b* subsequently exchange messages 86, 87, 88 and 89 among themselves, said messages being protected by keys and digital certificates.

Data or an information query 71 is now transmitted in a message 90 from the track-side device 35 to the vehicle 40. In the context of the exemplary embodiment described, it is assumed here that this takes place in the opposite direction to a transfer of cryptographic data from the vehicle 40 to the local management device 32 as explained above in connection with FIG. 2. Alternatively, this can however take place in a manner which is temporally independent of the corresponding transfer of cryptographic data, and the information query 71 may also be transmitted to a different vehicle of the railway system 10. In this case, the information query may relate to cryptographic procedures or realize corresponding procedures, e.g. a request for an update of certificates, or be unrelated to cryptographic procedures, e.g. a transfer of diagnostic data.

The transmitted data is stored in the storage device 42 of the vehicle 40 and is forwarded from the vehicle 40 beyond the transfer range of the track-side device 35 to the central device 20 of the railway system 10. This is indicated by the messages 92 and 93 in FIG. 3. An exchange of communication in the form of messages 95 and 96 subsequently takes place in the central device 20, messages 97 and 98 being exchanged in the decentral device 30 as the same time. A message 99 is then used to transmit an information reply 72 from the central device 20 to a further vehicle 40*a*, which is therefore not the vehicle 40. In a similar manner to the vehicle 40, the further vehicle 40*a* has a further control device 41*a*, a further storage device 42*a* and a further communication device 43*a* and moves in a direction of travel 45*a* towards the decentral device 30. As soon as the further vehicle 41*a* is in the communication range of the track-side device 35, it transmits the information reply 72 by means of messages 100/101 to the track-side device 35 or the local management device thereof. The latter transmits the information reply or a respective part thereof in messages 102, 103 and 104 to the fail-safe signaling devices 31, 31*a* and 31*b*, whereby these can be supplied with necessary information or updates. This means that it is advantageously also possible to perform procedures comprising a plurality of communication steps, e.g. in the form of an update of certificates or a transmission of a certificate black list, by means of multiple journeys by vehicles 40, 40*a*. It is thereby also possible to realize complex handshake procedures, for example. The corresponding data transported by the vehicles 40, 40*a* is protected again here, e.g. using a transport key.

In accordance with the foregoing explanations in connection with the exemplary embodiments as described above of the inventive method, the inventive vehicle and the inventive railway system, these have the advantage in particular that they allow a transmission of in particular cryptographic data from a control center to decentral track-side devices even in the absence of a direct communication link between them. Automatic transport of the corresponding data is effected here by means of vehicles or trains using storage devices installed therein. The relevant data is then transmitted or downloaded at the respective remote location, such that a maintenance team is advantageously not required on site. In this way, the method can advantageously execute completely automatically and does not require any maintenance action. It is therefore also possible to perform key replacement more frequently, thereby increasing the IT safety without incurring additional costs. Furthermore, it is also advantageously possible to report the state of the local IT security at the remote location to the control center.

The invention claimed is:

1. A method of operating a railway system, the method comprising:

transmitting cryptographic data including at least one key from a central communication device to an on-board communication device of a vehicle of the railway system;

storing the cryptographic data in a storage device of the vehicle of the railway system, the cryptographic data including the at least one key, the vehicle being configured to transport the cryptographic data in its storage device; and transmitting the cryptographic data including the at least one key from the vehicle to at least one track-side device of the railway system when, on occasion of a journey of the vehicle, the vehicle is present within a communication range of the at least one track-side device;

replacing a key stored in the at least one track-side device with the at least one key transmitted to the at least one track-side device by the vehicle, ensuring a secured communication;

implementing procedures comprising a plurality of communication steps on occasion of at least one further journey of the vehicle or at least one further vehicle;

transmitting a report of the state of a local IT security at the at least one track-side device from the at least one track-side device to the vehicle or the further vehicle, and storing the report in the storage device of the vehicle; and transmitting the report from the vehicle or the further vehicle to the central communication device.

2. The method according to claim 1, which comprises transmitting the cryptographic data wirelessly from the vehicle to the at least one track-side device.

3. The method according to claim 2, which comprises transmitting the cryptographic data by radio communication.

4. The method according to claim 1, which comprises transmitting the cryptographic data from a central device of a public-key infrastructure of the railway system to the vehicle and storing the cryptographic data in the storage device by the vehicle.

5. The method according to claim 1, which comprises providing to the vehicle supplementary information comprising at least one characteristic variables selected from the group consisting of:

an identity of the at least one track-side device;

a communication address of the at least one track-side device;

a location of the at least one track-side device;

an extent of the communication range; and a location of a respective line at or after which the cryptographic data must be transmitted from the vehicle to the at least one track-side device.

6. The method according to claim 1, wherein the track-side device is a local management device of the railway system; and the cryptographic data is distributed from the local management device to at least one further local component of the railway system.

7. The method according to claim 1, wherein the cryptographic data is transmitted from the vehicle to the at least one track-side device during the journey of the vehicle.

8. The method according to claim 1, wherein the cryptographic data is encrypted or otherwise protected when it is being transmitted from the vehicle (40) to the at least one track-side device.

9. The method according to claim 1, which comprises:

transmitting data from the track-side device or at least one of the track-side devices to the vehicle or another vehicle which is present within the communication range at a given point in time;

storing the transmitted data in the storage device of the respective vehicle; and forwarding the data from the respective vehicle at a location beyond the communication range of the at least one track-side device to a central device of the railway system.

10. The method according to claim 1, wherein the procedures comprising a plurality of communication steps are an update of certificates or a transmission of a certificate black list.

11. A vehicle of a railway system, the vehicle comprising:

an on-board communication device configured to receive cryptographic data including at least one key from a central communication device;

a storage device configured to store the cryptographic data with the at least one key, the vehicle being configured to transport the cryptographic data in its storage device;

a control device for detecting that the vehicle is present within a communication range of at least one track-side device of the railway system during a journey; and a communication device configured for transmitting the cryptographic data including the at least one key to the at least one track-side device;

replacing a key stored in the at least one track-side device with the at least one key transmitted to the at least one track-side device by the vehicle, ensuring a secured communication;

the railway system being configured to implement a plurality of communication steps on occasion of at least one further journey of the vehicle or at least one further vehicle;

the at least one track-side device being configured to transmit a report of the state of a local IT security at the at least one track-side device, to the vehicle or the further vehicle the report being stored in the storage device of the vehicle, and the report being transmitted from the vehicle or the further vehicle to the central communication device.

12. The vehicle according to claim 11, wherein the communication device is configured for wireless transmission of the cryptographic data from the vehicle to the at least one track-side device.

13. The vehicle according to claim 12, wherein the communication device is a radio communication device.

14. A railway system, comprising at least one vehicle according to claim 11 and a central device configured to transmit the cryptographic data to the at least one vehicle, and wherein the at least one vehicle is configured to store the cryptographic data in the storage device.

15. The railway system according to claim 14, wherein the railway system is configured to provide the vehicle with supplementary information with at least one characteristic variable selected from the group consisting of:

an identity of the at least one track-side device;

a communication address of the at least one track-side device;

a location of the at least one track-side device;

an extent of the communication range; and a location of a respective line at or after which the cryptographic data must be transmitted from the vehicle to the at least one track-side device.

16. The railway system according to claim 14, further comprising:

a track-side device being a local management device of the railway system; and said local management device being configured to distribute the cryptographic data to at least one further local component of the railway system.

17. The railway system according to claim 14, configured to implement the method according to claim 7.

* * * * *